United States Patent [19]

Florian et al.

[11] Patent Number: 4,823,575

[45] Date of Patent: Apr. 25, 1989

[54] CYLINDER LOCK AND KEY

[75] Inventors: David W. Florian, Southington; Thomas F. Hennessy, Bristol, both of Conn.

[73] Assignee: Bauer Kaba AG, Sicherheits-Schliessyteme, Switzerland

[21] Appl. No.: 101,501

[22] Filed: Sep. 28, 1987

[51] Int. Cl.[4] ..... E05B 63/00

[52] U.S. Cl. ..... 70/358; 70/493; 70/419; 70/421

[58] Field of Search ..... 70/358, 364 A, 393, 70/402, 405, 406, 407, 409, 411, 416, 419, 421, 493

[56] References Cited

U.S. PATENT DOCUMENTS

| | | | |
|---|---|---|---|
| 1,832,498 | 11/1931 | Murzio | 70/406 |
| 1,994,095 | 3/1935 | Caldwall | 70/409 |
| 3,393,542 | 7/1968 | Crepinsek | 70/421 |
| 3,961,506 | 6/1976 | Perez | 70/411 |
| 4,325,242 | 4/1982 | Tietz | 70/409 |
| 4,440,010 | 4/1984 | Guiraud | 70/409 |

FOREIGN PATENT DOCUMENTS

| | | | |
|---|---|---|---|
| WO85/02644 | 6/1985 | European Pat. Off. | 70/40 C |

*Primary Examiner*—Robert L. Wolfe

*Attorney, Agent, or Firm*—Chilton, Alix & Van Kirk

[57] ABSTRACT

A cylinder lock system employs a key which has a pair of projections extending from opposing parallel edges of the key blade. The keyway of the lock has an enlarged slot portion for receiving the projections upon insertion of the key. One of the projections cams pins of an auxiliary pin stack to present a shear line between the pins to permit rotation of the key plug to an unlocked mode. The other projection is received in a groove formed in the shell and is engageable against a surface of the groove upon rotation of the key to retain the key within the keyway.

26 Claims, 5 Drawing Sheets

CYLINDER LOCK AND KEY

BACKGROUND OF THE INVENTION

(A) FIELD OF THE INVENTION

The present invention relates generally to cylinder locks and associated keys. More particularly, the present invention is directed to pin tumbler-type cylinder locks and associated keys which exhibit improved pick-resistance and wear-resistant characteristics for both the lock and the key. Accordingly, the general objects of the present invention are to provide novel and improved devices of such character.

(B) DESCRIPTION OF THE PRIOR ART

Cylinder locks have proved immensely popular due to their versatility, ease of installation, modest cost and the relatively high degree of security provided by such locks. While numerous techniques have been advanced for enhancing the pick-resistance and the overall security provided by cylinder lock systems, conventional cylinder locks and keys are frequently subject to accelerated wear which can ultimately jeopardize the integrity and/or operability of the cylinder lock systems. Such excessive wear results not only from intense usage, but also frequently results from employing the inserted key and cooperating lock as a knob or handle for forcing the door open. By using the key/lock as a doorknob or fulcrum point, damaging stresses can be exerted on components of the lock mechanism and portions of the key so as to greatly accelerate the wear of the key and the lock.

U.S. Pat. No. 4,440,010 entitled "Lock and Key Device" discloses a locking system employing a key with a rib which extends from an upper portion of the key which is adjacent the bow. The rib is insertable into the keyway and cooperates with an inner face portion of the lock. Upon rotation the rib prevents the key from being removed from the lock as long as the key has not been rotated a complete revolution. The key rib also cooperates with portions of the lock so that the lock may be operated a considerable number of times without jeopardizing the precise positioning of the key in relation to the fittings of the locking mechanism.

U.S. Pat. No. 1,832,498 entitled "Tumbler Lock and Key Therefor" discloses a key which has a projecting pin at the shank of the key near the head. The pin is receivable in the keyway. The keyway is configured so that the key can only be inserted into the keyway in a given angular position, and the key must be rotated a full 360° before withdrawal from the lock is permitted. The pin thus functions to retain the inserted key in the lock cylinder upon rotation of the key.

U.S. Pat. No. 3,961,506 entitled "Locks" discloses a lock and key assembly wherein the key has adjustable formations which project from one edge of the key blade. The lock has adjustable tumblers which cooperate with the formations on the key blade so as to afford a variable combination lock and key assembly. The adjustable formations on the key are disclosed as grub-screws which are threaded into transversely spaced threaded bores along one edge of the key blade. These screws may be caused to project various distances from the edge of the key blade to form the lock engaging formations for unlocking the lock.

The above-discussed examples of the prior art do not afford the requisite degree of security while simultaneously affording protection against wear induced damage to the key and/or lock.

SUMMARY OF THE INVENTION

The present invention comprises a new and improved cylinder lock and a key therefor which cooperate to enhance the wear-resistant characteristics of a lock system. A key in accordance with the invention has a pair of opposing projecting structures on the edges of its blade portion. Upon insertion of the key, a first one of the projecting structures cooperates with a pin tumbler sub-assembly in the cylinder lock to, in part, unlock the cylinder plug for rotation relative to the shell and to retain the key in the lock. The other projecting structure functions principally as a bearing member to absorb forces exerted against the key when the inserted key is rotated to unlock the door and then pushed and/or pulled to force open the door.

Briefly stated, the lock in a preferred form comprises a shell which has at least one row of "conventional" pin tumbler receiving chambers and at least one auxiliary pin tumbler receiving chamber. The shell also defines a longitudinally engagable key engagement surface which traverses the interior portion of the shell in a generally equidistantly spaced relationship with the central longitudinal axis of the shell. A plug is rotatably mounted in the shell. The plug has a forward face and a longitudinally extending keyway. The keyway comprises a first slot portion and a second slot portion which opens through the face and has a transverse dimension which is greater than the transverse dimension of the first slot portion. The large or second slot portion generally intersects the shell auxiliary pin tumbler receiving chamber and the shell key engagement surface. The plug has at least one row of "conventional" pin tumbler receiving chambers which are alignable with the pin tumbler chambers of the row of pin tumbler chambers in the shell, and at least one auxiliary pin tumbler receiving chamber which is alignable with the shell auxiliary pin tumbler receiving chamber. A shear line is defined between the shell and the plug. Pin tumbler stacks, comprising "upper" and "lower" pin tumblers, are reciprocally mounted in the pin chambers. The pin tumbler stacks are resiliently biased so that first ends of the "lower" pin tumblers are positionable in the keyway. The pin tumbler stacks extend across the shear line and the ends of the "upper" pin tumblers thereof are disposed in the shell pin tumbler receiving chambers whereby the pin tumbler stacks coact with the plug and the shell in the locked mode to prevent rotation of the plug relative to the shell. Insertion of a properly configured key in the keyway causes reciprocation of the pin tumbler stacks whereby the shear lines between the upper and lower pin tumblers register with the shear line between the key plug and the shell and rotation of the plug relative to the shell to the unlocked position is permitted. A projecting structure on the key, in the rotated position of the plug, engages the key engagement surface of the shell to prevent withdrawal of the key for at least a portion of the key rotation.

The enlarged second slot portion of the keyway extends transversely in opposing directions from the central longitudinal axis of the reduced, i.e., slot portion, of the keyway a greater distance than the corresponding transverse extent of the reduced slot portion. The shell is provided with a groove having a generally annular shape. This groove is generally axially symmetrical about the central longitudinal axis of the shell, and substantially circumferentially extends about the interior of the shell. The above-mentioned key engagement surface comprises at least a portion of the wall which defines the groove in the shell. This wall may have opposing surfaces which are inclined relative to the longitudinal axis of the shell.

A key in accordance with the present invention includes a bow and a portion which defines a reference stop or stops. A blade longitudinally extends from the bow and includes a pair of longitudinally extending, transversely spaced, generally flat, parallel edge portions. A pair of aligned projections extend outwardly from the parallel edge portions of the blade. The projections will typically be located in close proximity to the reference stop(s) and are substantially equidistantly longitudinally spaced with respect to the stop(s). The projections each have a minimum width, measured transversely of the blade edge portions, which is less than the width of the key edge portions. The distances from the free ends of the projections to the associated key blade edge portions, i.e., the height of the projections, is substantially equal and significantly less than the corresponding transverse dimensions of the blade. In one embodiment the projections are substantially identical hardened pins which are press fit into the blade. In another embodiment of the key, the projections are integral with the blade. The free ends of the projections are shaped to define at least a first cam surface which faces the end of the blade disposed remotely from the bow. In a preferred embodiment, the projections are shaped to effectively define cam surfaces on at least three sides. These camming surfaces may be defined by converging portions of a longitudinally extending segment at an outer transverse terminus of the projections. In one reduction to practice the projections, at least in the region of the free ends thereof, were frustum shaped. In another reduction to practice the projections, at least in the region of the free ends thereof, were in the form of truncated pyramids.

A cylinder lock system in accordance with the present invention comprises a key having a longitudinally extending blade with a pair of transversely spaced parallel edges. Coaxial projections extend from each of the key blade edges. The lock comprises a shell which defines a key engagement surface at an interior portion of the shell. A plug is rotatably mounted in the shell. The plug has a forward face and longitudinally extending keyway which comprises a transversely reduced slot portion and a transversely enlarged slot portion opening through the face for receiving the key so that the key blade projections are receptively accommodated by the enlarged slot portion. Upon insertion of the key in the keyway, one of the projections cams the auxiliary pin tumbler stack such that its shear line registers with the shear line between the key plug and the shell and rotation of the plug relative to the shell is permitted. During rotation of the key, the other projection is slidably rotatable and longitudinally engageable against the shell key engagement surface. The said other projection and the engagement surface interact to retain the key in the keyway until the key is returned to its original angular insert position, i.e., the key pull position.

BRIEF DESCRIPTION OF THE DRAWINGS

FIG. 6 is an enlarged fragmentary perspective view of a preferred embodiment of a key in accordance with the present invention.

DETAILED DESCRIPTION OF THE DISCLOSED EMBODIMENT

Figure 1:
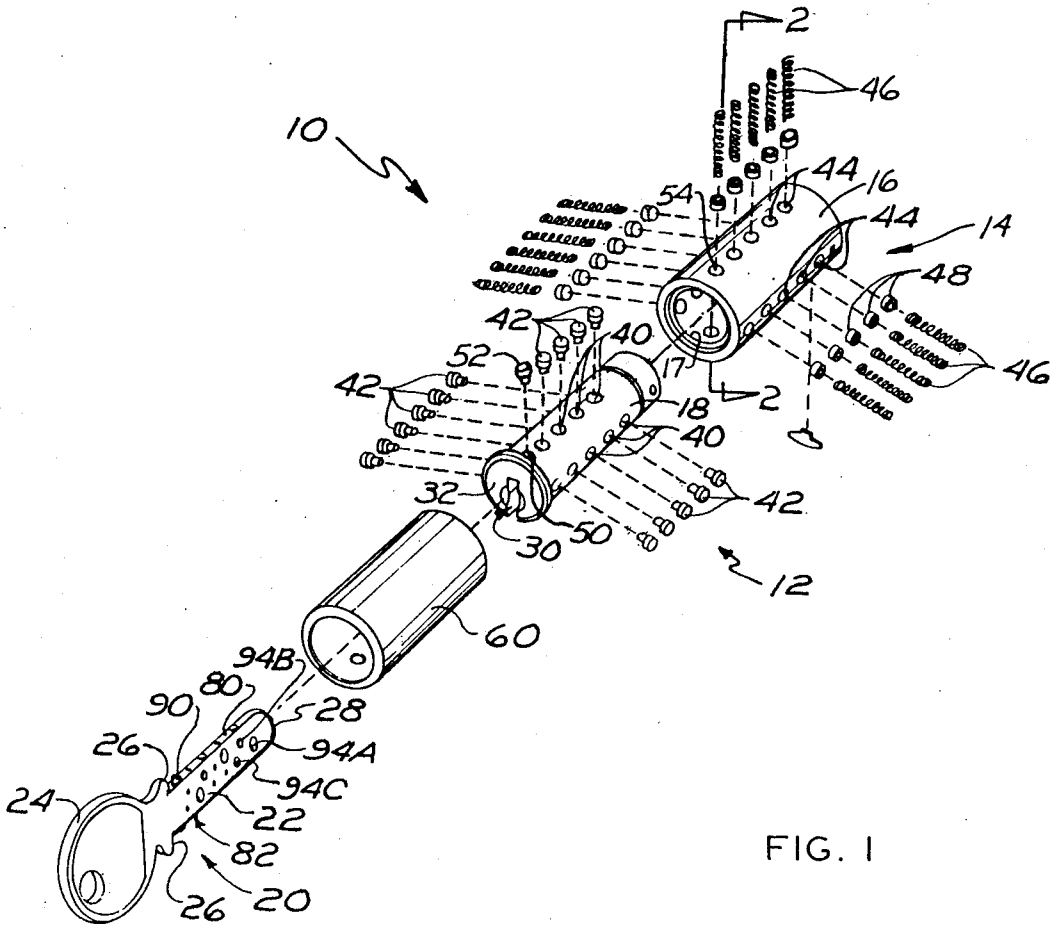
FIG. 1 is an exploded view of a cylinder lock and an associated key in accordance with the present invention.

With reference to the drawings, wherein like numerals represent like parts throughout the several figures, a cylinder lock in accordance with the present invention is generally designated in FIG. 1 by the numeral 10. Cylinder lock 10 comprises a plug sub-assembly 12 and a shell sub-assembly 14. The shell sub-assembly 14 comprises a tubular shell 16 which defines a cylindrical bore 17 for receiving a plug 18 of the plug sub-assembly 12. The construction of lock 10, except for the modifications described hereinafter, exemplifies that employed in conventional cylinder locks.

A key 20 having a blade 22 and a bow 24 in accordance with the present invention is associated with the lock 10 so that upon insertion of the blade of a properly bitted key, the plug 18 is rotatable within the bore 17 of the shell 16. With additional reference to FIG. 2, the plug 18 has a longitudinally extending bi-level keyway 30 which opens through the forward face 32 of the plug. The keyway 30 is an internal cavity which is preferrably in the form of a longitudinal slot having a transversely enlarged, longitudinally extending slot portion 34 adjacent the forward face 32 of the plug. The keyway 30 is dimensioned to receive the blade 22 of the key 20 and is generally complementary therewith. The bow 24 of the key has rear edges defining a stop 26 which engages the plug face 32 upon insertion of the key.

The rear end of the plug 18 has provision for mounting a lock actuator (not illustrated). The actuator rotates with the plug 18 and may be associated with conventional mechanisms such as, for example, a cam assembly, a retracting mechanism, etc.,. The foregoing arrangements are conventional and are not described further herein.

In the disclosed embodiment, the plug 18 has three angularly spaced rows of counterbores which define pin chambers 40 for receiving "bottom" pin tumblers 42. The shell 16 likewise has corresponding rows of pin chambers 44. The chambers 44 align with the chambers 40 when the lock is in the locked condition. Springs 46 and corresponding "top" or driver pins 48 are received in chambers 44.

In accordance with the invention, the plug 18 also has an auxiliary pin chamber 50. Chamber 50 is longitudinally positioned to open into the enlarged slot portion 34 at the forward end of the keyway. In the illustrated lock, chamber 50 is located longitudinally closer to plug face 32 than any of the chambers 40 and angularly aligns with the centrally disposed of the three rows of chambers 40. The chamber 50 receives an auxiliary "bottom" pin tumbler 52. The shell 16 has a counterbore which forms an auxiliary pin chamber 54 which receives a "top" auxiliary pin tumbler 58. The shell pin chamber 54 aligns with the plug pin chamber 50 when the plug 18 is in the key insertion position. A spring 56 is also received in the chamber 54. While chambers 50 and 54 are shown as having their aligned axes parallel with the sides of the key blade with the lock in the locked condition, it is to be understood that an angular relationship could be established so long as, in the manner to be described below, the pin stack in the aligned auxiliary pin chambers 50, 54 will be reciprocated upon key insertion.

A sleeve 60 encircles the shell 16 to retain the springs and pin stacks, i.e., the cooperating conventional top and bottom tumbler pins 42, 48 as well as he top and bottom auxiliary pins 52, 58, in assembled relationship.

In a conventional manner upon alignment of the plug chambers 40 with the shell chambers 44 and the auxiliary plug chamber 50 with the auxiliary shell chamber 54, and in the event that a key is not present in the keyway 30, the springs 46 and 56 will drive the respective top pins 48 and 58 partially into the respective plug chambers. If an improper key is inserted in the lock, at least some of the bottom pins will be driven into the shell pin chambers. In either case, pins will invade the shear line between the plug 18 and the shell 16 and will prevent rotation of the plug about its axis relative to the shell.

Figure 2:
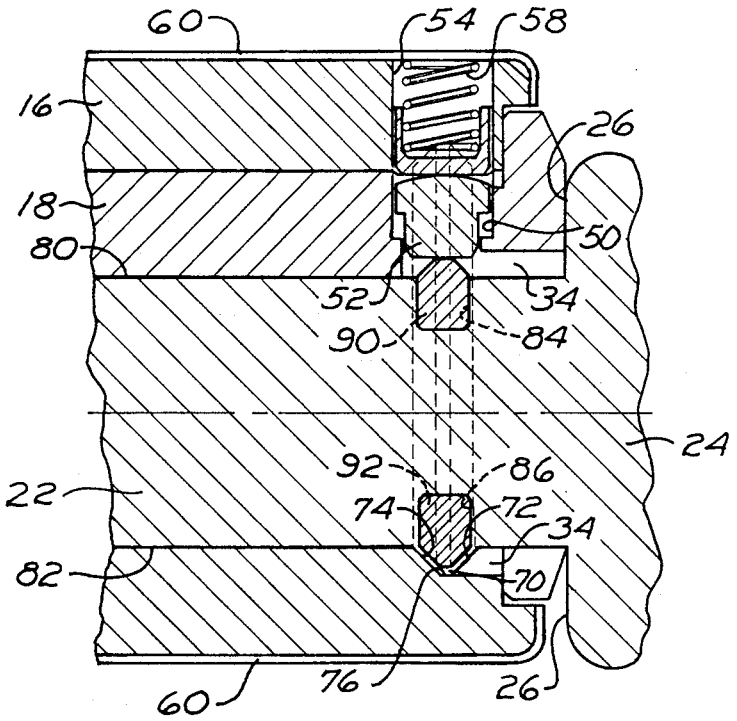
FIG. 2 is an enlarged fragmentary side sectional view of the lock and key taken along the line 2—2 of FIG. 1, said key being illustrated in an inserted and non-rotated position.
Figure 3:
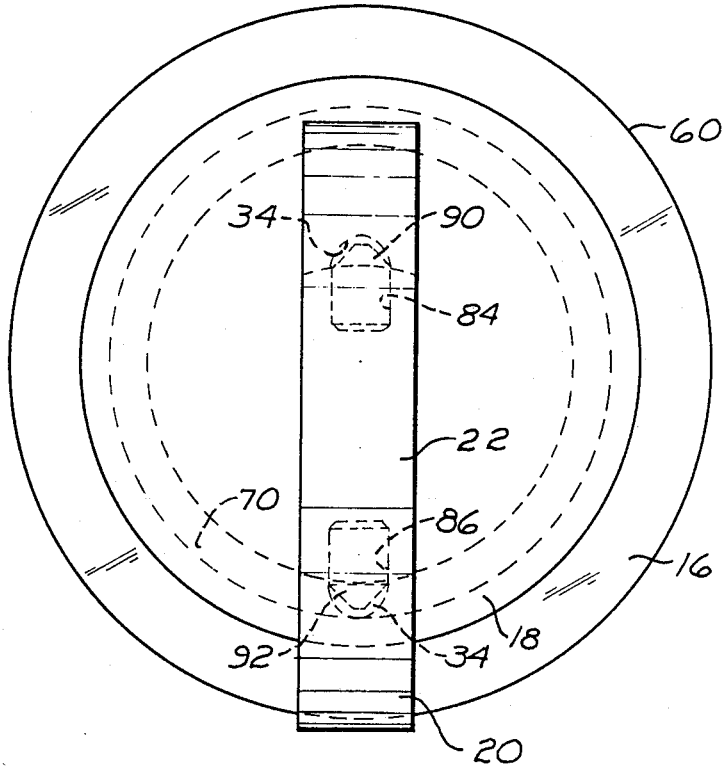
FIG. 3 is a front view, partly in phantom, of the lock and key of FIGS. 1 and 2.

With reference to FIGS. 2 and 3, the shell 16 further defines an annular groove 70 at the interior thereof. The groove 70 is symmetrically positioned relative to the central longitudinal axis of the shell and is longitudinally positioned to intersect, at or near the inner terminus of the keyway, the enlarged slot portion 34 of the keyway. The annular groove 70 defines a plane which extends generally orthogonally to the longitudinally extending central axis of the shell. In the illustrated embodiment, the central axis of the keyway is located eccentrically in relation to the annular groove 70. The annular groove 70 has a generally uniform cross-section which, in the disclosed embodiment, is defined by an inclined forward surface 72, an inclined rear surface 74 and an intermediate thin rim or cylinder-like surface 76 extending between the surfaces 72 and 74. Surface 72 functions as a longitudinally engageable retainer/bearing surface as will be more fully described below. Other groove shapes are also possible.

In accordance with the invention, key 20 includes a blade 22 which extends longitudinally from the bow 24. As disclosed herein, blade is defined by opposed longitudinally extending, parallel upper and lower edges 80 and 82 which are substantially flat and extend toward the terminus or tip 28 of the key. Edges 80 and 82 need extend only a portion of the longitudinal length of the blade. In accordance with a first embodiment, small coaxial transverse blind holes 84 and 86 are drilled into the blade through respective edges 80 and 82 at a pre-established distance from a stop 26. The stop 26 could, of course, be at the tip 28 of the blade. It is to be noted that the stop 26 is normally used as a reference for milling the key cuts, i.e., the code or bitting. It is also possible, when practicing the present invention, to use the surface 72 of groove 70 as a stop thus increasing the difficulty of making unauthorized keys, i.e., the usual reference may be somewhat encrypted. A pair of substantially identical projections 90 and 92, which may be in the form of hardened pins, are press fit into respective of holes 84 and 86 in the embodiment of FIG. 4. Projections 90 and 92 extend outwardly beyond the edge surfaces at opposing positions of the respective edges 80 and 82. The projections 90 and 92 are received in enlarged keyway slot portion 34 and longitudinally align with the annular groove 70 and the auxiliary pin chambers 50. Projection 90 thus will, upon key insertion, engage pin 52 while projection 92 is received in groove 70. Because the maximum diameter of the projections 90 and 92 is less than the width of key edges 80 and 82, the lateral dimension of the outer transverse portions of the enlarged slot portion 34 may be less than the corresponding lateral dimensions of the rest of the keyway. The key blade 22 also includes various cuts **94*a*, 94*b*, 94*c*, etc., of various depths and positions so as to engageably receive corresponding bottom pins 42 of the lock to thereby present a tumbler pin shear line between the shell and the plug upon insertion of a proper key. The edges of the blade 22** could, alternatively, be serrated along portions of their length to define the bitting.

Upon insertion of the proper key 20 into the keyway 30, the bottom pins 42 are each driven against a spring bias to a position wherein abutting ends of cooperating pairs of pin tumblers register with the shear line between the plug and the shell thereby permitting rotation of the plug. Projection 90 simultaneously cams auxiliary bottom pin 52 outwardly to present the proper auxiliary pin stack shear line, i.e., the abutting ends of pins 52 and 58 register with the shear line between plug 18 and shell 16. Projection 92 is received in groove 70. Upon rotation of the key, projection 92 is captured by the annular retainer groove 70. The key thus cannot be withdrawn from the lock until the key is rotated back to the key pull position which, in the illustrated embodiment of FIG. 1, may be described as the 12 o'clock position.

It will be appreciated that projection 92 functions to retain the inserted key in the lock and also interacts with a surface of groove 70 to function as a longitudinally acting bearing member. The projection-groove wall interaction results in the absorption and/or distribution of the forces exerted against the key/lock assembly under conditions when the key is employed for simultaneously unlocking the lock and as a fulcrum for pulling open the associated door. Projection 92 is essentially principally engageable against surface 72 to distribute pulling-type forces exerted through the inserted key. The projection/groove wall cooperation serves to prevent and/or alleviate excessive stresses being exerted against the pin stacks and or the key cuts. Consequently, forces which may be applied to the key at angles which are not tangential to the rotational axis of the plug are efficiently distributed to the shell through the captured projection 92.

Figure 4:
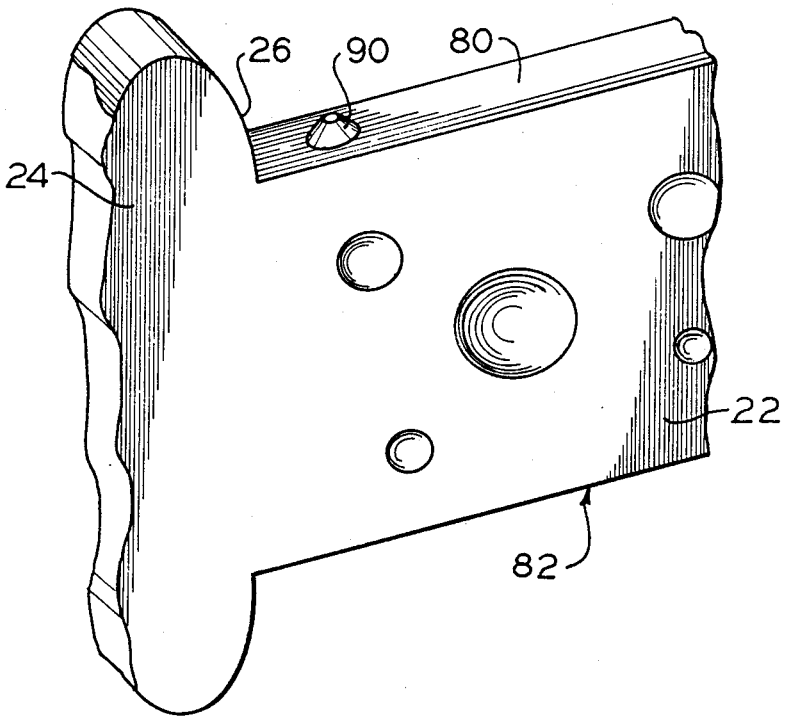
FIG. 4 is an enlarged fragmentary perspective view of the key of FIG. 1 in accordance with the present invention.

With additional reference to FIG. 4, in a first embodiment of a reversible key in accordance with the invention the projections 90 and 92 are, as noted above, identical pins which are press fit into the key blade to form a rigid integrated structure. As shown, the pins 90, 92 have a frustoconical shape. The maximum diameter of the press-fit pins is less than the maximum width of the edge of the key blade. The pins 90 and 92 are contoured so as to cam the auxiliary pin tumbler stack outwardly and to also define a bearing surface for interaction with the groove walls. The pins or projections need not be identical since each pin/projection essentially has a different mechanical function. For bi-directional, i.e., reversible, key systems such as illustrated, wherein the key may be properly inserted with either edge up, the projections are substantially identical while performing separate and distinct functions. It is essential that the projections of a reversible key present a first cam surface for smoothly causing reciprocation of the auxiliary pin tumbler pin stack during key insertion. It is also necessary, if the key is to be rotated 180° to unlock, as is the typical case, that the projections be provided with at least a "second" cam surface so that the projection which does not perform the unlocking function will not "hang up" on the edge of the auxiliary upper tumbler pin 58 as the 180° rotation position is approached. If the key is to be turned in both the clockwise and counterclockwise directions, which is also the typical situation, a "third" cam surface, which is opposite to the "second" cam surface, will be provided on the projection to insure smooth operation. The use of a conically shaped projection, of course, provides the three cam surfaces at minimal cost but dictates that the groove surfaces 72 and 74 be inclined.

Figure 5:
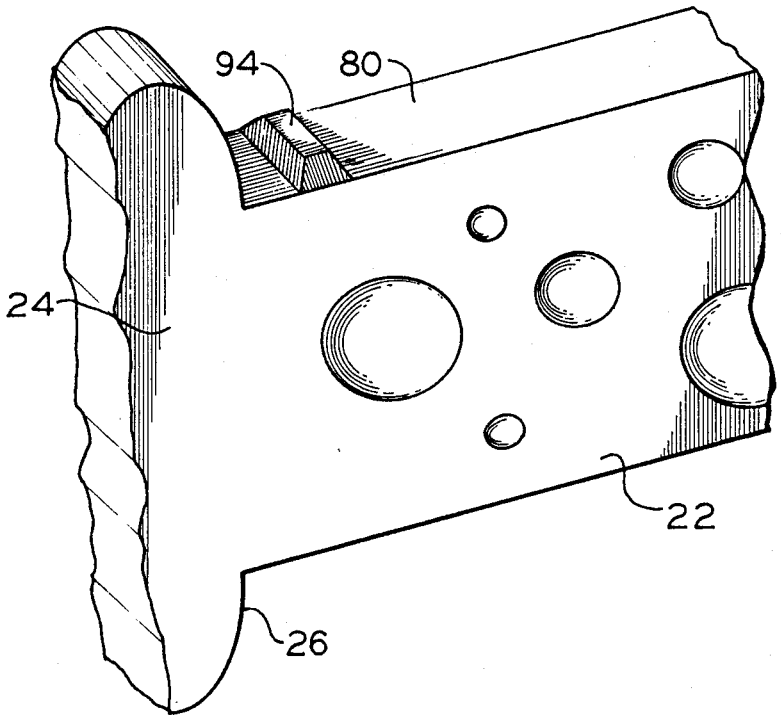

Referring to FIG. 5, in the preferred embodiment the projections take the form of opposing truncated pyramid-like structures 94 (only one illustrated). Structures 94 such as illustrated in FIG. 5 may be milled or otherwise integrally formed on the key blade. The truncated pyramid-like structures define the three above-discussed cam surfaces for cooperation with the auxiliary pin tumblers 52 and 58. The groove of the lock and corresponding key engagement surfaces (not illustrated) of the shell are, of course, dimensioned to complement the shape of the key projections. In one reduction to practice the side of the projections 94 which faced the stop 26 was transverse to the blade, i.e., parallel to the stop surface and the groove surface 72 was oriented generally transversely with respect to the bottom of the groove. For ease of manufacturing, the base portions of the projections 94 are equal to the key blade width while the minimum width thereof is less than the blade width. However, the projections 94 could be of smaller maximum width than the blade and the projections 94 may be offset, i.e., may be non-symmetrical, with respect to the center of the blade edges thus increasing the number of key combinations.

It will be appreciated that the projections 90 and 92 and/or 94 function to unlock the plug for rotation within the shell and also function as bearing points for absorbing non-rotational forces which are exerted through an inserted key. The cylinder lock may assume various pin tumbler configurations. The key may also have various cut configurations in terms of form and location for providing the locking and unlocking function between the plug and the shell. The axial location of groove 70 may also be varied in the interest of enhancing the number of key combinations.

While preferred embodiments of the invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A lock comprising:

shell means including a shell having a forward end, a longitudinally spaced rear end and a longitudinal axis, said shell means defining at least a first row of primary pin tumbler means receiving chambers and an auxiliary pin tumbler means receiving chamber, said shell means further defining a bearing surface traversing an interior portion thereof in generally equidistantly spaced relationship with said longitudinal axis, said bearing surface being juxtapositioned to said forward end;

plug means rotatably mounted in said shell means, said plug means having a forward face and defining a longitudinally extending keyway comprising a reduced slot portion and an enlarged slot portion extension, said enlarged slot portion extension opening through said face and generally intersecting said shell means auxiliary pin tumbler means receiving chamber, said enlarged slot portion extension also being in radial alignment with said bearing surface, said plug means defining at least a first row of primary pin tumbler means receiving chambers alignable with said shell means pin tumbler means receiving chambers and an auxiliary pin tumbler means receiving chamber alignable with said shell means auxiliary pin tumbler means receiving chamber, a shear line being defined between said shell means and said plug means; and tumbler means reciprocally mounted in said plug means primary and auxiliary chambers, said pin tumbler means each having first ends which are biasable into said keyway and second ends oppositely disposed with respect to said first ends, said pin tumbler means extending across said shear line, said pin tumbler means second ends being engaged in respective ends of said shell means pin tumbler means receiving chambers whereby said pin tumbler means coact with said plug means and shell means in the locked condition of the lock to prevent rotation of said plug means relative to said shell means, said pin tumbler means each defining a shear line, insertion of a properly configured key in said keyway causing reciprocation of said pin tumbler means whereby the shear lines of said pin tumbler means register with the shear line between the key plug means and the shell means and rotation of said plug means relative to said shell means to the unlocked position of the lock is permitted, the key being engageable with said bearing surface to prevent withdrawal of the key during at least a portion of the key rotation.

2. The lock of claim 1 wherein said reduced slot portion has a central longitudinal axis and said enlarged slot portion extends transversely in opposing directions from said slot axis a greater lateral distance than the corresponding transverse extent of said reduced slot portion.

3. The lock of claim 1 wherein said shell has an interior surface which defines a groove having a generally annular shape, said groove being generally axially symmetrical about said shell longitudinal axis and substantially extending about the entire interior circumference of said shell, said bearing surface comprising at least a portion of a wall of said groove.

4. The lock of claim 3 wherein said groove is defined by a pair of opposing wall surfaces which are oppositely inclined relative to the longitudinal axis of said shell.

5. The lock of claim 1 wherein said bearing surface is defined by a generally annular groove which intersects said shell auxiliary pin means receiving chamber.

6. The lock of claim 5 wherein said reduced slot portion has a central longitudinal axis and said enlarged slot portion extends transversely in opposing directions from said slot axis a greater lateral distance than the corresponding transverse extent of said reduced slot portion.

7. A reversible key for a cylinder lock comprising:

a bow;

a blade longitudinally extending from said bow and comprising a pair of sides and a pair of longitudinally extending oppositely disposed spaced edges which interconnect said sides, said sides being at least in part substantially parallel to one another; and a projection extending outwardly from each of said oppositely disposed parallel parts of said edges in fixed relationship therewith, said projections being substantially in alignment, said projections having a minimum width at the free ends thereof which is less than the width of said parallel parts of said edges, said projections each being shaped to define at least a first cam surface, said cam surface facing the end of the blade disposed oppositely to the bow.

8. The key of claim 7 wherein said projections have a substantially flat surface at the free ends thereof.

9. The key of claim 7 wherein said projections additionally define a second cam surface which faces one of said sides.

10. The key of claim 9 wherein said projections have a substantially flat surface at free ends thereof.

11. The key of claim 7 further comprising a reference stop.

12. The key of claim 10 further comprising a reference stop, said stop being integral with said blow.

13. The key of claim 7 wherein said projections are substantially identical pins which are press fit into said blade.

14. The key of claim 7 wherein said projections have generally frustoconically shaped tip portions at the free ends thereof.

15. The key of claim 7 wherein said projections are integral with said blade and are generally convergent toward the free ends thereof.

16. The key of claim 15 wherein said projections additionally define at least a second cam surface which faces one of said blade sides.

17. The key of claim 16 wherein said projections define four generally flat side surfaces.

18. A cylinder lock system comprising:

a key comprising a bow portion and a blade which longitudinally extends from said bow portion to a tip, said blade having a pair of transversely spaced parallel edges which are interconnected by side surfaces, said blade being provided with surface irregularities which define the key bitting, a shaped camming projection transversely extending from each of said edges, said projections being aligned and being spaced from but adjacent to the junction of said blade and bow portion;

shell means including a shell having a longitudinal axis, said shell means defining at least a first row of primary pin tumble means receiving chambers and an auxiliary pin tumbler means receiving chamber, said shell means further defining an engagement surface traversing an interior portion thereof;

plug means rotatably mounted in said shell means, said plug means having a forward face and a longitudinally extending keyway, said keyway having a first slot portion of reduced height and a second slot portion of greater height when compared to said first slot portion, said second slot portion opening through said face for receiving said key so that said key projections may be inserted into said enlarged slot portion, said plug means defining at least a first row of primary pin tumbler means receiving chambers alignable with said shell means primary pin tumbler means receiving chambers and an auxiliary pin tumbler means receiving chamber alignable with said shell means auxiliary pin tumbler means receiving chamber, a shear line being defined between said shell means and said plug means; and pin tumbler means reciprocally mounted in said plug means chambers, said pin means having first ends which are normally biased into said keyway and second ends oppositely disposed with respect to said first ends, said pin means extending across said shear line, said pin means second ends engaging respective of said shell means chambers whereby said pin means coact with said plug means and shell means in the locked condition of the lock to prevent rotation of said plug means relative to said shell means, said pin means each defining a shear line;

insertion of said key in said keyway resulting in a first one of said projections engaging a pin means in said plug means auxiliary pin tumbler means receiving chamber and camming said engaged pin means radially outwardly whereby the shear line of said engaged pin means registers with the shear line between the key plug means and the shell means, the key blade surface irregularities causing the pin tumbler means in the primary chambers to be reciprocated to present shear lines at the plug/shell shear line whereby rotation of said plug means relative to said shell means to the unlocked position of the lock is permitted, the other of said projections being slidably rotatable and longitudinally engageable against said engagement surface.

19. The lock system of claim 18 wherein in a first angular position of said plug means, said key may be inserted, and upon rotation of said key and said plug means, said other projection and said engagement surface interact to retain said key in said keyway until the key is returned to said first angular position.

20. The lock system of claim 18 wherein said engagement means comprises a wall which at least partially defines a generally annular groove.

21. The lock system of claim 20 wherein said groove intersects the shell means auxiliary pin tumbler means receiving chamber.

22. The lock system of claim 21 wherein said key projections are substantially identically shaped.

23. The key of claim 22 wherein said key projections define first, second and third cam surfaces which respectively generally face said blade tip and in the same direction as said blade side surfaces.

24. The key of claim 23 wherein said projection cam surfaces are substantially flat.

25. The key of claim 24 wherein said projections define four generally flat side surfaces.

26. The lock of claim 6 wherein said groove extends about the interior circumference of said shell and is symmetrical with respect to said shell longitudinal axis, and wherein said bearing surface comprises at least a portion of a wall which defines said groove.

* * * * *